US010335641B2

(12) United States Patent
Mochizuki et al.

(10) Patent No.: US 10,335,641 B2
(45) **Date of Patent: *Jul. 2, 2019**

(54) GOLF BALL

(71) Applicant: Bridgestone Sports Co., Ltd., Tokyo (JP)

(72) Inventors: Katsunobu Mochizuki, Chichibushi (JP); Hiroyuki Nagasawa, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/995,165

(22) Filed: Jun. 1, 2018

(65) Prior Publication Data

US 2018/0290025 A1 Oct. 11, 2018

Related U.S. Application Data

(63) Continuation of application No. 14/976,669, filed on Dec. 21, 2015, now Pat. No. 10,046,208.

(51) Int. Cl.
*A63B 37/06* (2006.01)
*A63B 37/00* (2006.01)

(52) U.S. Cl.
CPC ..... *A63B 37/0076* (2013.01)

(58) Field of Classification Search
CPC ..... A63B 37/0031; A63B 37/0032
USPC ..... 473/377
See application file for complete search history.

(56) References Cited

U.S. PATENT DOCUMENTS

| | | | | |
|---|---|---|---|---|
| 6,747,100 | B2 | 6/2004 | Ichikawa et al. | |
| 6,939,251 | B2 | 9/2005 | Ichikawa et al. | |
| 8,182,367 | B2 | 5/2012 | Nagasawa et al. | |
| 8,367,781 | B2 | 2/2013 | Nagasawa et al. | |
| 8,747,255 | B2 | 6/2014 | Sullivan et al. | |
| 10,046,208 | B2 * | 8/2018 | Mochizuki ..... | A63B 37/0076 |

FOREIGN PATENT DOCUMENTS

| | | | |
|---|---|---|---|
| JP | 2002336378 | A | 11/2002 |
| JP | 4114198 | B2 | 7/2008 |
| JP | 4247735 | | 4/2009 |
| JP | 5212599 | B2 | 6/2013 |

* cited by examiner

*Primary Examiner* — Raeann Gorden
(74) *Attorney, Agent, or Firm* — Sughrue Mion, PLLC

(57) ABSTRACT

The invention provides a golf ball having a core and a cover of one or more layer encasing the core, wherein, letting HU-A and HU-B be respectively the Martens hardnesses measured at positions 100 μm and 200 μm inward from a surface of an outermost layer of the cover and toward a center of the core, and letting HU-C be the Martens hardness measured at a position 100 μm from an inner side of the outermost cover layer and toward the surface, HU-A or HU-B is harder than HU-C.

11 Claims, 1 Drawing Sheet

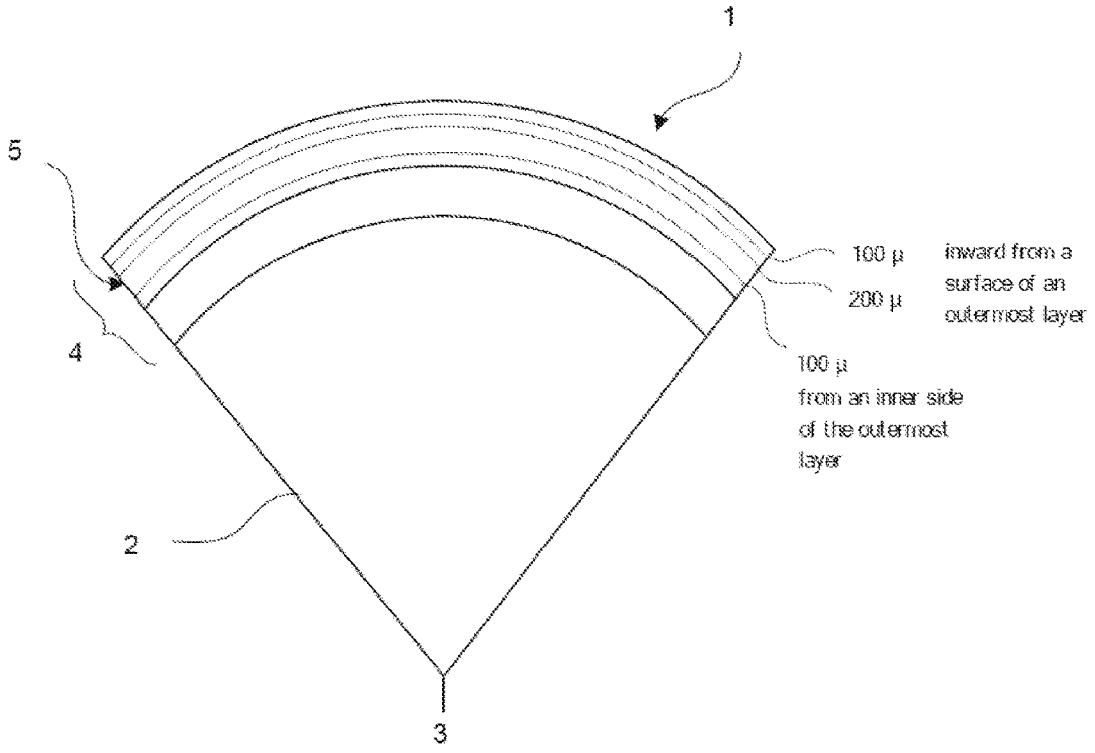
1
5
4
2
3
100 μ
200 μ
inward from a surface of an outermost layer
100 μ from an inner side of the outermost layer

GOLF BALL

CROSS-REFERENCE TO RELATED APPLICATIONS

This application is a continuation of U.S. patent application Ser. No. 14/976,669, filed Dec. 21, 2015, which has been allowed. The entire disclosure of the prior application is considered part of the disclosure of the accompanying continuation application, and is hereby incorporated by reference in its entirety.

BACKGROUND OF THE INVENTION

The present invention relates to a golf ball made of a core and a cover of one or more layer encasing the core. More particularly, the invention relates to an improved golf ball in which the microhardness of the cover is varied in the cross-sectional direction thereof, thereby endowing the ball with an excellent scuff resistance and spin properties and also an excellent feel on approach shots.

The outermost layer of the cover has hitherto been obtained by injection molding a specific resin material. Efforts have been made to lower the spin rate of the ball, improve the spin performance on approach shots, and also improve ball properties such as durability and scuff resistance, by suitably adjusting the material hardness of this outermost layer.

When commonly available general-purpose urethane materials for injection-molding are used as the cover material for golf balls, ball properties such as scuff resistance are inferior, and so various improvements have been carried out to date. For example, JP-A 2002-336378 describes a golf ball which uses a cover material made of a thermoplastic polyurethane material and an isocyanate mixture. JP 5212599 discloses a golf ball which has a high rebound and an excellent spin performance and scuff resistance, and the cover material for which has a high flowability, resulting in a high productivity.

However, although these golf balls do have an improved scuff resistance, given the harsh service environment of golf balls, an even higher level of scuff resistance has been desired. Also, common, general-purpose urethanes are inferior in terms of productivity and cost, in addition to which the foregoing conventional golf balls can hardly be said to have a good feel on approach shots.

SUMMARY OF THE INVENTION

It is therefore an object of the invention to provide a golf ball which has a scuff resistance and spin properties which are even better than those of prior-art golf balls, and which moreover has an excellent feel on approach shots.

The inventors have conducted extensive investigations, as a result of which they have discovered that, in a golf ball made of a core and a cover of one or more layer encasing the core, letting HU-A and HU-B be respectively the Martens hardnesses measured at positions 100 μm and 200 μm inward from a surface of an outermost layer of the cover and toward a center of the core, and letting HU-C be the Martens hardness measured at a position 100 μm from an inner side of the outermost cover layer and toward the surface, by making HU-A or HU-B harder than HU-C, the scuff resistance of the golf ball having such an outermost layer in the cover is excellent and a good spin performance can be obtained, in addition to which the feel on approach shots is even better.

Accordingly, the invention provides the following golf ball.

[1] A golf ball having a core and a cover of one or more layer encasing the core, wherein, letting HU-A and HU-B be respectively the Martens hardnesses measured at positions 100 μm and 200 μm inward from a surface of an outermost layer of the cover and toward a center of the core, and letting HU-C be the Martens hardness measured at a position 100 μm from an inner side of the outermost cover layer and toward the surface, HU-A or HU-B is harder than HU-C.

[2] The golf ball of [1] wherein, in the Martens hardnesses HU-A, HU-B and HU-C at the respective positions, HU-A and HU-B are both harder than HU-C.

[3] The golf ball of [1] wherein, in the Martens hardnesses HU-A, HU-B and HU-C at the respective positions, relative to an arbitrary value of 100 for HU-C, HU-A is 150 or more.

[4] The golf ball of [1] wherein, in the Martens hardnesses HU-A, HU-B and HU-C at the respective positions, relative to an arbitrary value of 100 for HU-C, HU-B is 130 or more.

[5] The golf ball of [1] which, letting HU-C be the Martens hardness measured at a position 100 μm from the inner side of the outermost cover layer and toward the surface and letting EIT-A (MPa) be the elastic modulus measured at a position 100 μm inward from the surface of the outermost cover layer and toward the center of the core, satisfies the following formula:

$$(EIT-A) \geq 24 \times (HC-C) - 140$$

[6] The golf ball of [1], wherein the outermost layer of the cover is molded of a thermoplastic material selected from the group consisting of polyurethane, polyurea and mixtures thereof, and the surface of the cover is treated with an isocyanate compound that is free of organic solvent.

[7] The golf ball of [1], wherein the isocyanate compound is one, two or more selected from the group consisting of tolylene-2,6-diisocyanate, tolyene-2,4-diisocyanate, 4,4'-diphenylmethanediisocyanate, polymethylene polyphenyl polyisocyanate, 1,5-diisocyanatonaphthalene, isophorone diisocyanate (including isomer mixtures), dicyclohexylmethane-4,4'-diisocyanate, hexamethylene-1,6-diisocyanate, m-xylylene diisocyanate, hydrogenated xylylene diisocyanate, tolidine diisocyanate, norbornene diisocyanate, derivatives thereof, and prepolymers formed of said isocyanate compounds.

[8] The golf ball of [7], wherein the isocyanate compound is one or a mixture selected from the group consisting of 4,4'-diphenylmethane diisocyanate and polymethylene polyphenyl polyisocyanate.

[9] The golf ball of [8], wherein the isocyanate compound is a mixture of 4,4'-diphenylmethane diisocyanate and polymethylene polyphenyl polyisocyanate.

[10] The golf ball of [1], wherein the outermost layer has a thickness of from 0.3 to 3.0 mm.

BRIEF DESCRIPTION OF THE DRAWING

The FIGURE is a diagram illustrating one embodiment of a golf ball of the present invention and showing measurement positions for Martens hardnesses in the interior of an outermost layer of a cover of the golf ball.

DETAILED DESCRIPTION OF THE INVENTION

The invention is described more fully below.

The inventive golf ball, by specifying, in a golf ball having a core and a cover of one or more layer encasing the core, the cross-sectional hardnesses at specific places in an outermost layer of the cover and varying the cross-sectional hardness, improves various aspects of ball performance, including scuff resistance, spin performance and feel on approach shots.

Specifically, letting HU-A and HU-B be respectively the Martens hardnesses measured at positions 100 μm and 200 μm inward from a surface of an outermost layer of the cover and toward a center of the core, and letting HU-C be the Martens hardness measured at a position 100 μm from an inner side of the outermost cover layer and toward the surface, the ball is characterized in that HU-A or HU-B is harder than HU-C.

Referring to the FIGURE, golf ball 1 includes core 2 having core center 3, and further includes cover 4 of one or more layers and comprising outermost layer 5. HU-A and HU-B, respectively, are Martens hardnesses measured at positions 100 μm and 200 μm inward from a surface of outermost layer 5 of cover 4 and toward a center of the core. HU C is the Martens hardness measured at a position 100 μm from an inner side of outermost cover layer 5 and toward the surface.

The Martens hardnesses HU-A, HU-B and HU-C at these positions can be measured with an ultra-microhardness tester based on ISO 14577:2002 ("Metallic materials—Instrumented indentation test for hardness and materials parameters"). That is, these Martens hardnesses are physical values determined by pressing an indenter to which a load is being applied against the object under measurement, and are calculated as (test load)/(surface area of indenter under test load) [N/mm$^2$]. It is possible to carry out measurement of the Martens hardness using, for example, the ultra-microhardness test system available under the trade name Fischerscope H-100 (Fischer Instruments). This instrument uses a diamond pyramidal Vickers indenter, and can measure the hardness of the outermost layer while continuously increasing the load in a stepwise manner. In this invention, the ultra-microhardness test conditions are set to room temperature and an applied load of 50 mN for a 10-second period.

Advantages of the above ultra-microhardness test system include the ability to obtain, with a single indentation test, supplementary data on characteristic properties such as elasticity and viscosity behaviors and creep properties. In addition, the very small indentation depth allows even thin-films to be tested.

The measurement positions for the Martens hardnesses HU-A and HU-B were set respectively 100 μm and 200 μm inward from the surface of the outermost layer and toward the core center because the inventors discovered that higher Martens hardnesses 100 μm and 200 μm inside of the surface are associated with a better ball scuff resistance. When the measurement position is less than 100 μm from the surface of the outermost layer toward the core center, such measurement ends up being affected by the surface shape of the outermost layer; the results obtained from measuring the Martens hardness at such positions lack stability, which is undesirable. The reason for measuring the Martens hardness HU-C at a position 100 μm from an inner side of the outermost cover layer and toward the surface is that the inventors discovered that, by imparting a hardness difference between the inner side and the outer side of the outermost layer, a good feel on approach shots can be obtained. However, when the place of Martens hardness measurement is less than 100 μm from the inner side of the outermost layer and toward the surface, there is a possibility that the measurement will be affected by the surface state of the core layer to the inside thereof, leading to a lack of stability in the measured results for the Martens hardness, which is undesirable. In addition, it was surmised that the Martens hardness can be stably measured here, and that the Martens hardness difference is greatest at about 100 μm and 200 μm inward from the surface of the outermost layer and toward the center of the core. As used herein, "the surface of the outermost layer" refers to land areas of the ball surface, and not to the interior of dimples.

In the Martens hardnesses HU-A, HU-B and HU-C at the respective above positions, when HU-A or HU-B is harder than HU-C, this means that there is a hardness variation within the outermost layer such that the inside portion of the outermost layer is relatively soft and the outside portion is relatively hard. This property is presumed to affect the ball structure on shots with a driver and on approach shots, contributing to improvements in ball performance attributes such as scuff resistance, spin performance, and feel on approach shots.

In the Martens hardnesses HU-A, HU-B and HU-C at the respective positions, when HU-A is harder than HU-C, the hardness difference is not particularly limited. However, relative to an arbitrary value of 100 for HU-C, HU-A is preferably at least 150, and more preferably at least 160. When this hardness difference is too small, improvements in the feel on approach shots and the scuff resistance may be insufficient. Similarly, relative to an arbitrary value of 100 for HU-C, HU-B is preferably at least 130, and more preferably at least 140. When this hardness difference is too small, improvements in the feel on approach shots and the scuff resistance may be insufficient.

Letting HU-C be the Martens hardness measured at a position 100 μm from the inner side of the outermost cover layer and toward the surface and letting EIT-A (MPa) be the elastic modulus measured at a position 100 μm inward from the surface of the outermost cover layer and toward the center of the core, to obtain a good scuff resistance and a good feel on approach shots, it is preferable for the golf ball to satisfy the following formula.

$$(EIT-A) \geq 24 \times (HU-C) - 140$$

The above elastic modulus (also called the "indentation modulus") EIT-A (MPa) is a physical value determined by pressing the indenter, while applying a load thereto, against the object under measurement. It is possible to carry out such measurement using, for example, the ultra-microhardness test system available under the trade name Fischerscope H-100 (Fischer Instruments).

Letting HU-C be the Martens hardness measured at a position 100 μm from the inner side of the outermost cover layer and toward the surface, the value of HU-C is preferably from 1 to 45, and more preferably from 5 to 30. Outside of this range, golf ball properties such as scuff resistance and spin performance may not satisfy the target performance.

The thickness of the outermost layer may be set in the range of 0.3 to 3.0 mm, preferably from 0.4 to 2.0 mm, and more preferably from 0.5 to 1.5 mm. Outside of this range, golf ball properties such as the scuff resistance and spin performance may not satisfy the target performance.

When the cover is formed as a multilayer structure of two or more layers, the thickness of the layers other than the outermost layer, although not particularly limited, may be set in the range of from 0.1 to 5.0 mm, preferably from 0.3 to 3.0 mm, and more preferably from 0.5 to 2.0 mm.

The outermost layer having the above-described specific hardness variation within the layer can be molded by injection-molding a known resin composition over the core or an intermediate sphere. In particular, to impart a specific hardness variation within the outermost layer, the outermost layer is molded of a thermoplastic material selected from the group consisting of polyurethane, polyurea and mixtures thereof. This hardness variation can be achieved by also treating the surface of the cover with an isocyanate compound that is free of organic solvent.

The proportion of the overall resin composition accounted for by the polyurethane, polyurea or a mixture thereof, although not particularly limited, may be set to at least 50 wt %, and preferably at least 80 wt %. The polyurethane and polyurea are described below.

Polyurethane

The thermoplastic polyurethane material has a structure which includes soft segments composed of a polymeric polyol that is a long-chain polyol (polymeric glycol), and hard segments composed of a chain extender and a polyisocyanate. Here, the polymeric polyol serving as a starting material is not subject to any particular limitation, and may be any that is used in the prior art relating to thermoplastic polyurethane materials. Exemplary polymeric polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. Illustrative examples of polyester polyols include adipate-based polyols such as polyethylene adipate glycol, polypropylene adipate glycol, polybutadiene adipate glycol and polyhexamethylene adipate glycol; and lactone-based polyols such as polycaprolactone polyol. Illustrative examples of polyether polyols include poly(ethylene glycol), poly(propylene glycol), poly(tetramethylene glycol) and poly(methyltetramethylene glycol). These may be used singly or as a combination of two or more thereof.

The number-average molecular weight of these long-chain polyols is preferably in the range of 500 to 5,000. By using a long-chain polyol having such a number-average molecular weight, golf balls made with a thermoplastic polyurethane composition having excellent properties such as the above-mentioned resilience and productivity can be reliably obtained. The number-average molecular weight of the long-chain polyol is more preferably in the range of 1,500 to 4,000, and even more preferably in the range of 1,700 to 3,500.

Here, and below, "number-average molecular weight" refers to the number-average molecular weight calculated based on the hydroxyl number measured in accordance with JIS K-1557.

The chain extender is not particularly limited, although preferred use may be made of those employed in the prior art relating to thermoplastic polyurethanes. A low-molecular-weight compound which has a molecular weight of 2,000 or less and bears on the molecule two or more active hydrogen atoms capable of reacting with isocyanate groups may be used in this invention, with the use of an aliphatic diol having from 2 to 12 carbons being preferred. Specific examples of the chain extender include 1,4-butylene glycol, 1,2-ethylene glycol, 1,3-butanediol, 1,6-hexanediol and 2,2-dimethyl-1,3-propanediol. Of these, the use of 1,4-butylene glycol is especially preferred.

The polyisocyanate compound is not subject to any particular limitation, although preferred use may be made of those employed in the prior art relating to thermoplastic polyurethanes. Specific examples include one, two or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, 1,4-bis(isocyanatomethyl)cyclohexane and dimer acid diisocyanate. Depending on the type of isocyanate used, the cross-linking reaction during injection molding may be difficult to control.

Although not an essential ingredient, a thermoplastic resin or elastomer other than a thermoplastic polyurethane may also be included. More specifically, use may be made of one, two or more selected from among polyester elastomers, polyamide elastomers, ionomer resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because these increase the resilience and scuff resistance due to reaction with the isocyanate groups while yet maintaining a good productivity. When these ingredients are included, the content thereof is suitably selected so as to, for example, adjust the cover material hardness, improve the resilience, improve the flow properties or improve adhesion. The content of these ingredients, although not particularly limited, may be set to preferably at least 5 parts by weight per 100 parts by weight of the thermoplastic polyurethane component. Although there is no particular upper limit, the content per 100 parts by weight of the thermoplastic polyurethane component may be set to preferably not more than 100 parts by weight, more preferably not more than 75 parts by weight, and even more preferably not more than 50 parts by weight.

The ratio of active hydrogen atoms to isocyanate groups in the above polyurethane-forming reaction may be adjusted within a desirable range so as to make it possible to obtain golf balls which are made with a thermoplastic polyurethane composition and have various improved properties, such as rebound, spin performance, scuff resistance and productivity. Specifically, in preparing a thermoplastic polyurethane by reacting the above long-chain polyol, polyisocyanate compound and chain extender, it is desirable to use the respective components in proportions such that the amount of isocyanate groups included in the polyisocyanate compound per mole of active hydrogen atoms on the long-chain polyol and the chain extender is from 0.95 to 1.05 moles.

No particular limitation is imposed on the method of preparing the thermoplastic polyurethane. Preparation may be carried out by either a prepolymer process or a one-shot process using a known urethane-forming reaction.

A commercial product may be used as the above thermoplastic polyurethane material. Illustrative examples include the products available under the trade name "Pandex" from DIC Bayer Polymer, Ltd., and the products available under the trade name "Resamine" from Dainichiseika Color & Chemicals Mfg. Co., Ltd.

Polyurea

The polyurea is a resin composition composed primarily of urea linkages formed by reacting (i) an isocyanate with (ii) an amine-terminated compound. This resin composition is described in detail below.

(i) Isocyanate

The isocyanate is preferably one that is used in the prior art relating to thermoplastic polyurethanes, but is not subject to any particular limitation. Use may be made of isocyanates similar to those described above in connection with the polyurethane material.

(ii) Amine-Terminated Compound

An amine-terminated compound is a compound having an amino group at the end of the molecular chain. In the present invention, the long-chain polyamines and/or amine curing agents shown below may be used.

A long-chain polyamine is an amine compound which has on the molecule at least two amino groups capable of reacting with isocyanate groups, and which has a number-average molecular weight of from 1,000 to 5,000. In this invention, the number-average molecular weight is more preferably from 1,500 to 4,000, and even more preferably from 1,900 to 3,000. Within this average molecular weight range, an even better resilience and productivity are obtained. Examples of such long-chain polyamines include, but are not limited to, amine-terminated hydrocarbons, amine-terminated polyethers, amine-terminated polyesters, amine-terminated polycarbonates, amine-terminated polycaprolactones, and mixtures thereof. These long-chain polyamines may be used singly, or as combinations of two or more thereof.

An amine curing agent is an amine compound which has on the molecule at least two amino groups capable of reacting with isocyanate groups, and which has a number-average molecular weight of less than 1,000. In this invention, the number-average molecular weight is more preferably less than 800, and even more preferably less than 600. Such amine curing agents include, but are not limited to, ethylenediamine, hexamethylenediamine, 1-methyl-2,6-cyclohexyldiamine, tetrahydroxypropylene ethylenediamine, 2,2,4- and 2,4,4-trimethyl-1,6-hexanediamine, 4,4'-bis(sec-butylamino)dicyclohexylmethane, 1,4-bis(sec-butylamino)cyclohexane, 1,2-bis(sec-butylamino)cyclohexane, derivatives of 4,4'-bis(sec-butylamino)dicyclohexylmethane, 4,4'-dicyclohexylmethanediamine, 1,4-cyclohexane bis(methylamine), 1,3-cyclohexane bis(methylamine), diethylene glycol di(aminopropyl)ether, 2-methylpentamethylenediamine, diaminocyclohexane, diethylenetriamine, triethylenetetramine, tetraethylenepentamine, propylenediamine, 1,3-diaminopropane, dimethylaminopropylamine, diethylaminopropylamine, dipropylenetriamine, imidobis(propylamine), monoethanolamine, diethanolamine, triethanolamine, monoisopropanolamine, diisopropanolamine, isophoronediamine, 4,4'-methylenebis(2-chloroaniline), 3,5-dimethylthio-2,4-toluenediamine, 3,5-dimethylthio-2,6-toluenediamine, 3,5-diethylthio-2,4-toluenediamine, 3,5-diethylthio-2,6-toluenediamine, 4,4'-bis(sec-butylamino)diphenylmethane and derivatives thereof, 1,4-bis(sec-butylamino)benzene, 1,2-bis(sec-butylamino)benzene, N,N'-dialkylaminodiphenylmethane, N,N,N',N'-tetrakis(2-hydroxypropyl)ethylenediamine, trimethylene glycol di-p-aminobenzoate, polytetramethylene oxide di-p-aminobenzoate, 4,4'-methylenebis(3-chloro-2,6-diethyleneaniline), 4,4'-methylenebis(2,6-diethylaniline), m-phenylenediamine, p-phenylenediamine and mixtures thereof. These amine curing agents may be used singly or as combinations of two or more thereof.

(iii) Polyol

Although not an essential component, in addition to the above-described components (i) and (ii), a polyol may also be included in the polyurea. The polyol is not particularly limited, but is preferably one that has hitherto been used in the art relating to thermoplastic polyurethanes. Specific examples include the long-chain polyols and/or polyol curing agents described below.

The long-chain polyol may be any that has hitherto been used in the art relating to thermoplastic polyurethanes. Examples include, but are not limited to, polyester polyols, polyether polyols, polycarbonate polyols, polyester polycarbonate polyols, polyolefin-based polyols, conjugated diene polymer-based polyols, castor oil-based polyols, silicone-based polyols and vinyl polymer-based polyols. These long-chain polyols may be used singly or as combinations of two or more thereof.

The long-chain polyol has a number-average molecular weight of preferably from 500 to 5,000, and more preferably from 1,700 to 3,500. In this average molecular weight range, an even better resilience and productivity are obtained.

The polyol curing agent is preferably one that has hitherto been used in the art relating to thermoplastic polyurethanes, but is not subject to any particular limitation. In this invention, use may be made of a low-molecular-weight compound having on the molecule at least two active hydrogen atoms capable of reacting with isocyanate groups, and having a molecular weight of less than 1,000. Of these, the use of aliphatic diols having from 2 to 12 carbons is preferred. Specific examples include 1,4-butylene glycol, 1,2-ethylene glycol, 1,3-butanediol, 1,6-hexanediol and 2,2-dimethyl-1,3-propanediol. The use of 1,4-butylene glycol is especially preferred. The polyol curing agent has a number-average molecular weight of preferably less than 800, and more preferably less than 600.

Where necessary, various additives may also be included in the polyurethane and polyurea. For example, pigments, inorganic fillers, dispersants, antioxidants, light stabilizers, ultraviolet absorbers and mold release agents may be suitably included.

A known method may be used to produce the polyurea. A prepolymer process, a one-shot process or some other known method may be suitably selected for this purpose.

The method of molding the cover using the polyurethane and the polyurea may involve, for example, feeding these materials to an injection-molding machine and injecting them over the core. The molding temperature in such a case varies depending on the formulation and other factors, but is generally in the range of 150 to 270° C.

Treatment of Cover Surface

Next, the golf ball of the invention is characterized in that the surface of the outermost cover layer molded as described above is treated with an isocyanate compound that is free of organic solvent. The method of carrying out this surface treatment is described below.

This treatment method uses an isocyanate compound that is free of organic solvent. The isocyanate compound, although not particularly limited, is typically selected from the following group.

Group of Isocyanate Compounds for Selection

The group consisting of tolylene-2,6-diisocyanate, tolylene-2,4-diisocyanate, 4,4'-diphenylmethane diisocyanate, polymethylene polyphenyl polyisocyanate, 1,5-diisocyanatonaphthalene, isophorone diisocyanate (including isomer mixtures), dicyclohexylmethane-4,4'-diisocyanate, hexamethylene-1,6-diisocyanate, m-xylylene diisocyanate, hydrogenated xylylene diisocyanate, tolidine diisocyanate, norbornene diisocyanate, derivatives of these, and prepolymers formed of such isocyanate compounds.

An aromatic isocyanate compound is preferably used as the isocyanate compound, with the use of 4,4'-diphenylmethane diisocyanate (monomeric, or "pure," MDI) or polymethylene polyphenyl polyisocyanate (polymeric MDI) being especially preferred. When an aromatic isocyanate compound is used in the invention, because it has a high reactivity with the reactive groups on the thermoplastic resin, the intended effects of the invention can be successively achieved. The use of polymeric MDI is preferred because it has a larger number of isocyanate groups than monomeric MDI and thus provides a large scuff resistance-improving effect due to crosslink formation, and moreover because it is in a liquid state at normal temperatures and thus has an excellent handleability. However, polymeric MDI generally has a dark brown appearance, which may discolor and contaminate the cover material to be treated. Because such discoloration is pronounced when treatment is carried out with polymeric MDI in the form of a solution obtained by dissolution in an organic solvent, in the practice of the invention, owing to concern over such discoloration, the polymeric MDI is used in a state that is free of organic solvents. Alternatively, commercial products may be suitably used as the polymeric MDI. Illustrative examples include Sumidur p-MDI 44V10, 44V20L, 44V40 and SBU Isocyanate J243 from Sumika Bayer Urethane Co., Ltd.; MONDUR MR Light from Bayer Material Science; PAPI 27 Polymeric MDI from Dow Chemical Company; Millionate MR-100, MR-200 and MR-400 from Tosoh Corporation; and Lupranate M20S, M11S and M5S from BASF INOAC Polyurethane, Ltd.

The preliminary treatments described in, for example, JP 4114198 and JP 4247735 may be suitably used as methods for reducing discoloration by polymeric MDI. Although the techniques described in these patent publications may be adopted for use here, the possibilities are not limited to these techniques alone. When such preliminary treatment is carried out and the treatment is followed by suitable washing, substantially no discoloration or contamination arises.

A dipping method, coating method (spraying method), infiltration method under heat and pressure application, dropwise addition method or the like may be suitably used as the method of treatment with the isocyanate compound. From the standpoint of process control and productivity, the use of a dipping method or coating method is especially preferred. The length of treatment by the dipping method is preferably from 1 to 180 minutes, more preferably from 10 to 120 minutes, and even more preferably from 20 to 90 minutes. When the treatment time is too short, a sufficient crosslinking effect is difficult to obtain. On the other hand, when the treatment time is too long, there is a possibility of substantial discoloration of the cover surface by excess isocyanate compound. Also, with a long treatment time, the production lead time becomes long, which is not very desirable from the standpoint of productivity. With regard to the temperature during such treatment, from the standpoint of productivity, it is preferable to control the temperature within a range that allows a stable molten liquid state to be maintained and also allows the reactivity to be stably maintained. The temperature is preferably from 10 to 80° C., more preferably from 15 to 70° C., and even more preferably from 20 to 60° C. If the treatment temperature is too low, infiltration and diffusion to the cover material or reactivity at the surface layer interface may be inadequate, as a result of which the desired properties may not be achieved. On the other hand, if the treatment temperature is too high, infiltration and diffusion to the outermost cover layer material or reactivity at the surface layer interface may increase and there is a possibility of greater discoloration of the outermost cover layer surface on account of excess isocyanate compound. Also, in cases where the ball appearance—including the shapes of the dimples—changes, or an ionomeric material is used in part of the golf ball, there is a possibility that this will give rise to changes in the physical properties of the ball. By carrying out treatment for a length of time and at a temperature in these preferred ranges, it is possible to obtain a sufficient crosslinking effect and, in turn, to achieve the desired ball properties without a loss of productivity.

To control the reactivity and obtain a golf ball having an even better scuff resistance and spin performance, a catalyst or a compound having two, three or more functional groups that react with isocyanate groups can be incorporated beforehand in the isocyanate compound treatment agent or in the outermost cover layer material to be treated. The method of incorporating such a compound may involve mixing the compound, in a dispersed state, with a liquid melt of the isocyanate compound treatment agent; using a mixer such as a single-screw or twin-screw extruder to mix the compound into the thermoplastic resin that is the material to be treated (cover material); or charging the respective ingredients in a dry blended state into an injection molding machine. When the last of these methods is used, during charging, the compound may be charged alone, or may be rendered beforehand into a masterbatch state using a suitable base material.

If, after treatment with the above isocyanate compound, excess isocyanate compound remains on the ball surface, this tends to cause adverse effects such as logo mark transfer defects and the peeling of paint, and moreover may lead to appearance defects such as discoloration over time. Hence, it is preferable to wash the ball surface with a suitable organic solvent, water or the like. Particularly in cases where polymeric MDI is used, because this compound is a dark brown-colored liquid, unless the ball surface is thoroughly washed, appearance defects may end up arising. The organic solvent used at this time should be suitably selected from among organic solvents that dissolve the isocyanate compound and do not dissolve the polyurethane, polyurea or a mixture thereof serving as a component of the outermost cover layer material. Preferred use can be made of esters, ketones as well other suitable organic solvents such as benzene, dioxane or carbon tetrachloride which dissolve the isocyanate compound. In particular, acetone, ethyl acetate, methyl ethyl ketone, methyl isobutyl ketone, toluene or xylene, either alone or in admixture, may be suitably used as the organic solvent, although the choices are not necessarily limited to these. Washing with the above organic solvent may be carried out by an ordinary method. For example, use may be made of dipping, shaking, ultrasound, microbubbles or nanobubbles, a submerged jet or a shower. It is desirable for the washing time to be set so as to complete washing in preferably not more than 120 seconds, more preferably not more than 60 seconds, and even more preferably not more than 30 seconds. If the washing time is long and excess washing occurs, although appearance defects due to the residual presence of isocyanate compound are suppressed, the isocyanate compound with which the surface of the golf ball cover has been treated may end up being removed, as a result of which crosslinking may not proceed to a sufficient degree. There is also a possibility of undesirable effects owing to penetration of the organic solvent into the outermost cover layer material and consequent swelling of the material, such as changes in shape due to the relaxation of residual stresses that have arisen in the outermost cover layer during molding, damage to the resin interface that has formed during molding, and dissolution of low-molecular-weight ingredients. Hence, it is preferable to carry out washing for a suitable treatment time. In addition, there is a possibility that an optimal flight performance may not be achieved or that the distance traveled by the ball may be adversely affected by solvent-induced changes in the dimple shapes or swelling of the support pin marks that form during injection molding.

Drying treatment may be carried out preliminary to surface treatment with the above isocyanate compound. That is, when treating an outermost cover layer molded from a thermoplastic material that includes a polyurethane, a polyurea or a mixture thereof, to remove moisture contained in the outermost cover layer material and thereby stabilize the physical properties following treatment and increase the life of the treatment solution, it may be desirable to carry out, as needed, drying treatment or the like beforehand, although this is not always the case. A common method such as warm-air drying or vacuum drying may be used as the drying treatment. Such treatment preliminary to surface treatment, particularly in the case of golf balls containing an ionomeric material in a portion thereof, is preferably carried out under conditions that do not cause deformation or changes in the physical properties. When warm air drying is carried in such preliminary treatment, although not particularly limited, it is desirable to set the temperature to from 15 to 60° C., and preferably from 20 to 55° C., and to set the time to preferably from 10 to 180 minutes, more preferably from 15 to 120 minutes, and even more preferably from 30 to 60 minutes. The drying conditions may be suitably selected according to the moisture content within the outermost cover layer material and are typically adjusted so that the moisture content in the outermost cover layer material becomes preferably 5,000 ppm or less, more preferably 3,500 ppm or less, even more preferably 2,500 ppm or less, and most preferably 1,000 ppm or less.

Following surface treatment with the isocyanate compound, it is preferable to provide a suitable curing step in order to have the crosslinking reactions between the polyurethane or polyurea thermoplastic material and the isocyanate compound effectively proceed, thereby enhancing and stabilizing the physical properties and quality, and also to control and shorten the production takt time. However, because reaction of the isocyanate proceeds even at room temperature, it is not always necessary to provide a curing step. In cases where a curing step is provided, a method that causes the crosslinking reactions to proceed under the effect of heat or pressure and in the presence of a catalyst may be suitably selected. Specifically, it is preferable to carry out heating treatment under suitable temperature and time conditions that are typically from 15 to 150° C. for up to 24 hours, preferably from 20 to 100° C. for up to 12 hours, and more preferably from 30 to 70° C. for up to 6 hours.

The degree to which, following surface treatment with the isocyanate compound, crosslinking reactions between the polyurethane or polyurea thermoplastic material and the isocyanate compound have proceeded can be determined by a suitable technique. For example, it is effective to use attenuated total reflectance (ATR) Fourier transform infrared absorption spectroscopy (FT-IR) to measure the ball surface after curing. The progress of the crosslinking reactions can be ascertained by examining peaks attributable to isocyanate groups and peaks attributable to NHCO groups. Alternatively, the degree to which crosslinking has proceeded can be determined by immersing the outermost cover layer material in a solvent such as tetrahydrofuran, chloroform or dimethylformamide, and measuring the weight of the dissolved matter.

The pickup of isocyanate compound following the above surface treatment can be suitably adjusted according to the weight and desired properties of the golf ball as a whole. This pickup, expressed in terms of weight change, is preferably in the range of 0.01 to 1.0 g, more preferably in the range of 0.03 to 0.8 g, and even more preferably in the range of 0.05 to 0.75 g. If the weight change is too small, impregnation by the isocyanate compound may be inadequate and suitable property enhancing effects may not be obtained. If the weight change is too large, control of the ball weight within a range that conforms to the rules for golf balls and various types of control, including of dimple changes, may be difficult. With regard to the depth of impregnation by the isocyanate compound, the process conditions may be suitably selected so as to obtain the desired physical properties. Modification by this method has the effect of, given that the isocyanate compound penetrates and disperses from the surface, making it easy to confer variations in the physical properties. Conferring physical property variations within an outermost cover layer of a given thickness simulates, and indeed serves the same purpose as, providing a cover layer that is itself composed of multiple layers, thus making it possible to achieve cover characteristics that never before existed. Moreover, the state of impregnation by the isocyanate compound may vary depending on whether an organic solvent is present. If an organic solvent is used, changes in the physical properties can be achieved to a greater depth; if an organic solvent is not used, changes in the physical properties are easily imparted at positions closer to the interface. When treatment is carried out by a method that does not use an organic solvent, the physical properties near the surface of the outermost cover layer and the physical properties at the cover interior are easily differentiated, which has the advantage of enabling a greater degree of freedom in golf ball design to be achieved.

The materials making up the covers layers other than the outermost layer are not particularly limited. These may be formed of, for example, ionomer resins, polyester resins, polyamide resins, and also polyurethane resins. For example, an ionomer resin or a highly neutralized ionomer resin may be used in the envelope layer and the intermediate layer, and the outermost layer may be formed of the above-described polyurethane resin.

The core may be formed using a known rubber material as the base material. A known base rubber such as natural rubber or a synthetic rubber may be used as the base rubber. More specifically, the use of primarily polybutadiene, especially cis-1,4-polybutadiene having a cis structure content of at least 40%, is recommended. Where desired, a natural rubber, polyisoprene rubber, styrene-butadiene rubber or the like may be used in the base rubber together with the above polybutadiene. The polybutadiene may be synthesized with a titanium-based, cobalt-based, nickel-based or neodymium-based Ziegler catalyst or with a metal catalyst such as cobalt or nickel.

Co-crosslinking agents such as unsaturated carboxylic acids and metal salts thereof, inorganic fillers such as zinc oxide, barium sulfate and calcium carbonate, and organic peroxides such as dicumyl peroxide and 1,1-bis(t-butylperoxy)cyclohexane may be blended with the base rubber. In addition, where necessary, other ingredients such as commercial antioxidants may suitably added.

As explained above, the golf ball of the invention, by imparting property variations within an outermost layer of a specific thickness, simulates, and thus serves the same purpose as, providing a cover layer that is itself composed of multiple layers. Moreover, by providing a hardness difference between the surface layer vicinity and the interior of the cover outer layer, a greater degree of freedom in golf ball design can be achieved than in the prior art. Finally, the golf ball of the invention has an even better scuff resistance, a good feel on approach shots, and moreover an excellent ball productivity.

EXAMPLES

Working Examples of the invention and Comparative Examples are given below by way of illustration, although the invention is not limited by the following Examples.

Examples 1 to 19, Comparative Examples 1 to 9

Cores having a diameter of 36.3 mm were produced by using the formulation shown in Table 1 to prepare a core-forming rubber composition common to all the Examples, then curing and molding at 155° C. for 15 minutes. Next, cover layers (these being, in order from the inside: an envelope layer and an intermediate layer) formulated of the various resin materials shown in the same table and common to all the Examples were successively injection-molded over the core, thereby giving an intermediate sphere. The envelope layer had a thickness of 1.3 mm and a material hardness, expressed in terms of Shore D hardness, of 51. The intermediate layer had a thickness of 1.1 mm and a material hardness, expressed in terms of Shore D hardness, of 62.

The outermost cover layer, which differs in each Example, was injection-molded over the intermediate sphere. The resin materials used to form the outermost layer are shown in Table 2. The outermost layer had a thickness of 0.8 mm. Although not shown in a diagram, numerous dimples were formed on the outside surface of the outermost layer at the same time as injection molding.

TABLE 1

| Ball component | | Formulated ingredients | Amounts |
|---|---|---|---|
| Cover | Intermediate layer | Himilan 1605 | 50 |
| | | Himilan 1557 | 15 |
| | | Himilan 1706 | 35 |
| | | Trimethylolpropane | 1.1 |
| | Envelope layer | HPF1000 | 100 |
| | Core | Polybutadiene A | 80 |
| | | Polybutadiene B | 20 |
| | | Organic peroxide | 1 |
| | | Barium sulfate | 21.5 |
| | | Zinc oxide | 4 |
| | | Zinc acrylate | 29.5 |

TABLE 1-continued

| Ball component | Formulated ingredients | Amounts |
|---|---|---|
| | Antioxidant | 0.1 |
| | Zinc salt of pentachlorothiophenol | 0.3 |

Details on these core materials are shown below. Numbers in the table indicate parts by weight.

Polybutadiene A: Available from JSR Corporation under the trade name "BR 01"

Polybutadiene B: Available from JSR Corporation under the trade name "BR 51"

Organic Peroxide: Dicumyl peroxide, available under the trade name "Percumyl D" (NOF Corporation)

Barium sulfate: Available from Sakai Chemical Co., Ltd. as "Precipitated Barium Sulfate 100"

Zinc oxide: Available from Sakai Chemical Co., Ltd.

Zinc acrylate: Available from Nihon Joryu Kogyo Co., Ltd.

Antioxidant: 2,2'-Methylenebis(4-methyl-6-t-butylphenol), available under the trade name "Nocrac NS-6" (Ouchi Shinko Chemical Industry Co., Ltd.)

Details on the cover (envelope layer, intermediate layer) materials are shown below. Numbers in the table indicate parts by weight.

HPF 1000: An ionomer from E.I. DuPont de Nemours & Co.

Himilan 1605: A sodium ionomer from DuPont-Mitsui Polychemicals Co., Ltd.

Himilan 1557: A zinc ionomer from DuPont-Mitsui Polychemicals Co., Ltd.

Himilan 1706: A zinc ionomer from DuPont-Mitsui Polychemicals Co., Ltd.

TABLE 2

| Resin formulation (pbw) | I | II | III | IV | V | VI |
|---|---|---|---|---|---|---|
| Pandex 18283 | 25 | | | 60 | 25 | |
| Pandex 18290 | 75 | 50 | | 40 | 75 | |
| Pandex 18295 | | 50 | 75 | | | 100 |
| Pandex 18260 | | | 25 | | | |
| Hytrel 4001 | 12 | 12 | 12 | 12 | 12 | 12 |
| Titanium oxide | 3.5 | 3.5 | 3.5 | 3.5 | 3.5 | 3.5 |
| Ultramarine | 0.4 | 0.4 | 0.4 | 0.4 | 0.4 | 0.4 |
| Polyethylene wax | 1 | 1 | 1 | 1 | 1 | 1 |
| Montan wax | 0.4 | 0.4 | 0.4 | 0.4 | 0.4 | 0.4 |
| Isocyanate compound | | | | 7.5 | 7.5 | 7.5 |

Details on the cover (outermost layer) materials are shown below. Numbers in the table indicate parts by weight.

T-8260, T-8283, T-8290, T-8295: Ether-type thermoplastic polyurethanes available under the trademark Pandex from DIC Bayer Polymer Hytrel 4001: A polyester elastomer available from DuPont-Toray Co., Ltd.

Polyethylene wax: Available under the trade name "Sanwax 161P" from Sanyo Chemical Industries, Ltd.

Titanium oxide: Tipaque R680, available from Ishihara Sangyo Kaisha, Ltd.

Isocyanate compound: 4,4'-Diphenylmethane diisocyanate

Next, in each of the Working Examples and Comparative Examples, surface treatment was carried out at the surface of the outermost layer using polymeric MDI available under the trade name "Sumidur p-MDI 44V20L" from Sumika Bayer Urethane Co., Ltd. This surface treatment involved successively carrying out the following steps: (1) 60 minutes of preliminary warming at 55° C., (2) dipping treatment in an isocyanate compound under the temperature and time conditions shown in Tables 3, 4 and 5, (3) 30 seconds of washing with acetone, and (4) 60 minutes of curing at 55° C. Dipping treatment in an isocyanate compound involved carrying out dipping treatment such that the entire ball is thoroughly immersed in isocyanate compound alone without using solvent.

Golf balls on which the above surface treatment had been carried out were tested and evaluated by the methods described below. The results are shown in Tables 3, 4 and 5.

Martens Hardnesses HU-A, HU-B and HU-C ($N/mm^2$) at Various Positions

The Martens hardnesses at positions 100 μm and 200 μm inward from the surface of the outermost cover layer and toward the center of the core (HU-A and HU-B) and the Martens hardness at a position 100 μm from the inner side of the outermost cover layer and toward the surface (HU-C) were measured using the ultra-microhardness test system available under the trade name Fischerscope H-100 (Fischer Instruments). Measurement was carried out using a diamond pyramidal Vickers indenter, at room temperature and under an applied load set to 50 mN/10 s.

Elastic Modulus: EIT-A (MPa)

The elastic modulus (indentation modulus) EIT-A at a position 100 μm inward from the surface of the outermost cover layer and toward the core center was measured using the ultra-microhardness test system available under the trade name Fischerscope H-100 (Fischer Instruments). Measurement was carried out using a diamond pyramidal Vickers indenter, at room temperature and under an applied load set to 50 mN/10 s.

Scuff Resistance

The balls were held at 23° C. and five balls of each type were hit at a head speed of 33 m/s using as the club a pitching wedge mounted on a swing robot machine. The damage to the ball from the impact was visually evaluated based on the following 5-point scale, and the average score for each type of ball was calculated.

5: No damage or substantially no damage.

4: Damage is apparent but so slight as to be of substantially no concern.

3: Surface is slightly frayed.

2: Some fraying of surface or loss of dimples.

1: Dimples completely obliterated in places.

Flight Performance

A driver (W #1) was mounted on a golf swing robot, and the spin rate and total distance when the ball was struck at a head speed of 45 m/s were measured. The club used was a TourStage X-Drive 707 (2012 model; loft angle, 9.5°) manufactured by Bridgestone Sports Co., Ltd.

Spin Performance on Approach Shots

A sand wedge (SW) was mounted on a golf swing robot, and the spin rate when the ball was struck at a head speed of 20 m/s was measured. The club used was a TourStage X-WEDGE (loft angle, 56°) manufactured by Bridgestone Sports Co., Ltd.

Productivity

The percentage of balls with defects such as burn contaminants was determined for 1,000 molded golf balls. Balls having a percent defective lower than 2.5% were rated as "Good"; balls having a percent defective of 2.5% or more were rated as "NG."

Feel on Approach Shots

Eight golfers scored the feel of the ball on approach shots based on the following three-point scale.

3: Good feel

2: Cannot say either way

1: Poor feel (When contact with the ball on approach shots is too crisp, the feel is often poor and there is a sense of poor controllability, which is not very desirable.)

TABLE 3

| | | Comp. Ex. | Example | | | Comp. Ex. | Example | | | Comp. Ex. | Example | | |
|---|---|---|---|---|---|---|---|---|---|---|---|---|---|
| | | 1 | 1 | 2 | 3 | 2 | 4 | 5 | 6 | 3 | 7 | 8 | 9 |
| Immersion Conditions | Resin material of outermost layer | I | I | I | I | I | I | I | I | II | II | II | II |
| | Treatment temperature (° C.) | 40 | 40 | 40 | 40 | 50 | 50 | 50 | 60 | 50 | 50 | 50 | 50 |
| | Treatment time (min) | 5 | 20 | 60 | 100 | 5 | 20 | 80 | 40 | 5 | 20 | 80 | 100 |
| HU Martens hardnesses | HU-A ($N/mm^2$) | 11.3 | 14.8 | 20.5 | 25.6 | 10.9 | 16.9 | 24.2 | 20.4 | 16.8 | 23.0 | 38.7 | 45.3 |
| | HU-B ($N/mm^2$) | 11.2 | 13.6 | 17.7 | 20.5 | 11.0 | 17.2 | 21.8 | 19.5 | 16.8 | 22.2 | 32.6 | 36.2 |
| | HU-C ($N/mm^2$) | 11.3 | 11.2 | 10.9 | 11.5 | 11.0 | 10.8 | 11.1 | 11.4 | 16.9 | 16.3 | 17.9 | 16.8 |
| | (HU-A) based on value of 100 for HU-C | 100 | 132 | 188 | 222 | 99 | 156 | 218 | 179 | 99 | 141 | 217 | 270 |
| | (HU-B) based on value of 100 for HU-C | 99 | 121 | 163 | 178 | 100 | 159 | 196 | 171 | 99 | 136 | 182 | 215 |
| EIT (elastic modulus) | EIT-A (MPa) | 98 | 110 | 180 | 248 | 99 | 142 | 238 | 189 | 172 | 226 | 451 | 534 |
| | 24× (HU-C)-140 (mPa) | 131 | 129 | 121 | 136 | 124 | 120 | 126 | 134 | 266 | 252 | 289 | 263 |

TABLE 3-continued

| | | | Comp. Ex. | Example | | | Comp. Ex. | Example | | | Comp. Ex. | Example | | |
|---|---|---|---|---|---|---|---|---|---|---|---|---|---|---|
| | | | 1 | 1 | 2 | 3 | 2 | 4 | 5 | 6 | 3 | 7 | 8 | 9 |
| Ball performance | Properties | Diameter (mm) | 42.69 | 42.7 | 42.69 | 42.71 | 42.7 | 42.69 | 42.73 | 42.74 | 42.69 | 42.7 | 42.74 | 42.72 |
| | | Weight (g) | 45.38 | 45.42 | 45.4 | 45.44 | 45.48 | 45.35 | 45.48 | 45.53 | 45.41 | 45.4 | 45.51 | 45.43 |
| | Scuff resistance | | 1.5 | 3.5 | 4.6 | 4.6 | 1.6 | 4.3 | 4.4 | 4.5 | 2.1 | 3.8 | 4.4 | 4.4 |
| | Flight performance | Spin rate (rpm) | 3,120 | 3,092 | 3,058 | 2,908 | 3,053 | 3,049 | 2,849 | 3,008 | 2,993 | 2,980 | 2,921 | 2,908 |
| | | Total distance (m) | 239.4 | 239.8 | 239.2 | 239.4 | 239.1 | 239.6 | 239.1 | 238.9 | 241.8 | 241.4 | 241.7 | 241.3 |
| | Spin performance on approach shots (rpm) | | 6,475 | 6,462 | 6,401 | 6,301 | 6,453 | 6,446 | 6,246 | 6,336 | 6,284 | 6,277 | 6,152 | 6,123 |
| | Productivity (rating) | | good | good | good | good | good | good | good | good | good | good | good | good |
| | Feel on approach shots (score) | | 3.0 | 3.0 | 3.0 | 3.0 | 3.0 | 3.0 | 3.0 | 3.0 | 3.0 | 3.0 | 3.0 | 3.0 |

TABLE 4

| | | | Comp. Ex. | Example | | | Comp. Ex. | Example | | |
|---|---|---|---|---|---|---|---|---|---|---|
| | | | 4 | 10 | 11 | 12 | 5 | 13 | 14 | 15 |
| Immersion conditions | Resin material of outermost layer | | III | III | III | III | III | III | III | III |
| | Treatment temperature (° C.) | | 40 | 40 | 40 | 40 | 50 | 50 | 50 | 50 |
| | Treatment time (min) | | 5 | 20 | 60 | 100 | 5 | 20 | 80 | 100 |
| HU Martens hardnesses | HU-A ($N/mm^2$) | | 24.3 | 26.0 | 32.6 | 45.3 | 24.3 | 30.0 | 47.5 | 53.4 |
| | HU-B ($N/mm^2$) | | 24.3 | 25.0 | 28.1 | 36.4 | 24.2 | 27.6 | 40.6 | 45.2 |
| | HU-C ($N/mm^2$) | | 24.4 | 24.3 | 25.5 | 24.3 | 24.3 | 24.3 | 24.3 | 24.5 |
| | (HU-A) based on value of 100 for HU-C | | 100 | 107 | 128 | 186 | 100 | 123 | 196 | 218 |
| | (HU-B) based on value of 100 for HU-C | | 100 | 103 | 110 | 150 | 100 | 114 | 167 | 184 |
| EIT (elastic modulus) | EIT-A (MPa) | | 319 | 330 | 392 | 597 | 320 | 351 | 624 | 727 |
| | 24× (HU-C)-140 (MPa) | | 446 | 443 | 471 | 443 | 443 | 443 | 442 | 448 |
| Ball performance | Properties | Diameter (mm) | 42.69 | 42.71 | 42.70 | 42.72 | 42.73 | 42.69 | 42.73 | 42.69 |
| | | Weight (g) | 45.38 | 45.35 | 45.32 | 45.39 | 45.31 | 45.30 | 45.40 | 45.39 |
| | Scuff resistance | | 2.1 | 3.3 | 3.6 | 3.9 | 2.2 | 2.9 | 4.5 | 4.8 |
| | Flight performance | Spin rate (rpm) | 2,883 | 2,798 | 2,788 | 2,772 | 2,882 | 2,872 | 2,852 | 2,815 |
| | | Total distance (m) | 231.0 | 232.5 | 233.6 | 232.9 | 230.2 | 231.6 | 231.6 | 233.7 |
| | Spin performance on approach shots (rpm) | | 6,130 | 6,095 | 6,074 | 6,009 | 6,182 | 6,151 | 6,036 | 6,031 |
| | Productivity (rating) | | good | good | good | good | good | good | good | good |
| | Feel on approach shots (score) | | 3.0 | 3.0 | 3.0 | 3.0 | 3.0 | 3.0 | 3.0 | 3.0 |

TABLE 5

| | | | Comp. Ex. | Example | | | | Comparative Example | | |
|---|---|---|---|---|---|---|---|---|---|---|
| | | | 6 | 16 | 17 | 18 | 19 | 7 | 8 | 9 |
| Immersion conditions | Resin material of outermost layer | | III | III | III | III | III | IV | V | VI |
| | Treatment temperature (° C.) | | 55 | 55 | 55 | 60 | 60 | — | — | — |
| | Treatment time (min) | | 5 | 20 | 60 | 20 | 40 | — | — | — |
| HU Martens hardnesses | HU-A ($N/mm^2$) | | 24.3 | 29.1 | 38.7 | 36.0 | 38.0 | 17.3 | 21.8 | 29.7 |
| | HU-B ($N/mm^2$) | | 24.2 | 26.5 | 32.6 | 31.7 | 34.1 | 17.3 | 21.8 | 29.7 |
| | HU-C ($N/mm^2$) | | 24.5 | 24.8 | 22.1 | 22.5 | 23.7 | 17.3 | 21.8 | 29.7 |
| | (HU-A) based on value of 100 for HU-C | | 99 | 117 | 175 | 160 | 161 | 100 | 100 | 100 |
| | (HU-B) based on value of 100 for HU-C | | 99 | 107 | 148 | 141 | 144 | 100 | 100 | 100 |
| EIT (elastic modulus) | EIT-A (MPa) | | 320 | 358 | 562 | 417 | 456 | 208 | 301 | 459 |
| | 24× (HU-C)-140 (MPa) | | 448 | 456 | 390 | 400 | 428 | 275 | 384 | 572 |
| Ball performance | Properties | Diameter (mm) | 42.71 | 42.69 | 42.72 | 42.70 | 42.73 | 42.72 | 42.68 | 42.74 |
| | | Weight (g) | 45.38 | 45.33 | 45.40 | 45.33 | 45.41 | 45.37 | 45.37 | 45.56 |
| | Scuff resistance | | 2.2 | 3.2 | 3.9 | 3.9 | 4.2 | 4.3 | 4.1 | 3.7 |
| | Flight performance | Spin rate (rpm) | 2,886 | 2,842 | 2,875 | 2,837 | 2,817 | 3,063 | 3,051 | 2,868 |
| | | Total distance (m) | 230.0 | 231.1 | 230.9 | 232.9 | 233.6 | 240.1 | 239.6 | 232.8 |
| | Spin performance on approach shots (rpm) | | 6,139 | 6,071 | 6,014 | 6,112 | 6,062 | 6,403 | 6,341 | 5,981 |
| | Productivity (rating) | | good | good | good | good | good | NG | NG | NG |
| | Feel on approach shots (score) | | 3.0 | 3.0 | 3.0 | 3.0 | 3.0 | 2.3 | 2.1 | 1.9 |

Based on the results in Tables 3 to 5, the balls obtained in the Comparative Examples were inferior in the following respects to those obtained in the Working Examples of the invention.

In Comparative Example 1, the Martens hardness HU-A or HU-B was the same as or lower than the HU-C hardness. As a result, the scuff resistance was inferior compared with Examples 1 to 3.

In Comparative Example 2, the Martens hardness HU-A or HU-B was the same as or lower than the HU-C hardness. As a result, the scuff resistance was inferior compared with Examples 4 to 6.

In Comparative Example 3, the Martens hardness HU-A or HU-B was lower than the HU-C hardness. As a result, the scuff resistance was inferior compared with Examples 7 to 9.

In Comparative Example 4, the Martens hardness HU-A or HU-B was lower than the HU-C hardness. As a result, the scuff resistance was inferior compared with Examples 10 to 12.

In Comparative Example 5, the Martens hardness HU-A or HU-B was the same as or lower than the HU-C hardness. As a result, the scuff resistance was inferior compared with Examples 13 to 15.

In Comparative Example 6, the Martens hardness HU-A or HU-B was lower than the HU-C hardness. As a result, the scuff resistance was inferior compared with Examples 16 to 19.

In Comparative Example 7, treatment with isocyanate was not carried out and so the Martens hardness HU-A or HU-B was the same as the HU-C hardness. As a result, compared with Example 2 having the same spin performance, the scuff resistance was inferior, the ball productivity was poor, and the feel on approach shots was also poor.

In Comparative Example 8, treatment with isocyanate was not carried out and so the Martens hardness HU-A or HU-B was the same as the HU-C hardness. As a result, compared with Example 6 having the same spin performance, the scuff resistance was inferior, the ball productivity was poor, and the feel on approach shots was also poor.

In Comparative Example 9, treatment with isocyanate was not carried out and so the Martens hardness HU-A or HU-B was the same as the HU-C hardness. As a result, compared with Examples, 14, 15 and 17 to 19 having the same spin performance, the scuff resistance was inferior, the ball productivity was poor, and the feel on approach shots was also poor.

The invention claimed is:

1. A golf ball comprising a core and a cover of one or more layer encasing the core, wherein, letting HU-A and HU-B be respectively the Martens hardnesses measured at positions 100 μm and 200 μm inward from a surface of an outermost layer of the cover and toward a center of the core, and letting HU-C be the Martens hardness measured at a position 100 μm from an inner side of the outermost cover layer and toward the surface, HU-A or HU-B is harder than HU-C, wherein the value of HU-A is from 14.8 to 53.4 $N/mm^2$ and the value of HU-B is from 13.6 to 45.2 $N/mm^2$.

2. The golf ball of claim 1 wherein, in the Martens hardnesses HU-A, HU-B and HU-C at the respective positions, HU-A and HU-B are both harder than HU-C.

3. The golf ball of claim 1 wherein, in the Martens hardnesses HU-A, HU-B and HU-C at the respective positions, relative to an arbitrary value of 100 for HU-C, HU-A is 150 or more.

4. The golf ball of claim 1 wherein, in the Martens hardnesses HU-A, HU-B and HU-C at the respective positions, relative to an arbitrary value of 100 for HU-C, HU-B is 130 or more.

5. The golf ball of claim 1 which, letting HU-C be the Martens hardness measured at a position 100 μm from the inner side of the outermost cover layer and toward the surface and letting EIT-A (MPa) be the elastic modulus measured at a position 100 μm inward from the surface of the outermost cover layer and toward the center of the core, satisfies the following formula:

$$(EIT-A) \geq 24 \times (HU-C) - 140.$$

6. The golf ball of claim 1, wherein the value of HU-C is from 1 to 45 $N/mm^2$.

7. The golf ball of claim 1, wherein the outermost layer of the cover is molded of a thermoplastic material selected from the group consisting of polyurethane, polyurea and mixtures thereof, and the surface of the cover is treated with an isocyanate compound that is free of organic solvent.

8. The golf ball of claim 7, wherein the isocyanate compound is one, two or more selected from the group consisting of tolylene-2,6-diisocyanate, tolylene-2,4-diisocyanate, 4,4'-diphenylmethanediisocyanate, polymethylene polyphenyl polyisocyanate, 1,5-diisocyanatonaphthalene, isophorone diisocyanate (including isomer mixtures), dicyclohexylmethane-4,4'-diisocyanate, hexamethylene-1,6-diisocyanate, m-xylylene diisocyanate, hydrogenated xylylene diisocyanate, tolidine diisocyanate, norbornene diisocyanate, derivatives thereof, and prepolymers formed of said isocyanate compounds.

9. The golf ball of claim 8, wherein the isocyanate compound is one or a mixture selected from the group consisting of 4,4'-diphenylmethane diisocyanate and polymethylene polyphenyl polyisocyanate.

10. The golf ball of claim 9, wherein the isocyanate compound is a mixture of 4,4'-diphenylmethane diisocyanate and polymethylene polyphenyl polyisocyanate.

11. The golf ball of claim 1, wherein the outermost layer has a thickness of from 0.4 to 3.0 mm.

* * * * *